US005251901A

United States Patent [19]

Solheim et al.

[11] Patent Number: 5,251,901

[45] Date of Patent: Oct. 12, 1993

[54] WOOD TYPE GOLF CLUBS

[75] Inventors: John A. Solheim, Phoenix; Anthony D. Serrano, Glendale, both of Ariz.

[73] Assignee: Karsten Manufacturing Corporation, Phoenix, Ariz.

[21] Appl. No.: 24,791

[22] Filed: Mar. 1, 1993

Related U.S. Application Data

[63] Continuation of Ser. No. 839,953, Feb. 21, 1992, abandoned.

[51] Int. Cl.[5] ..... A63B 53/04

[52] U.S. Cl. ..... 273/167 A; 273/167 F; 273/172

[58] Field of Search .... 273/167 R, 167 A, 167 E-167 H, 273/169, 171, 172, 173, 77 A

[56] References Cited

U.S. PATENT DOCUMENTS

| | | | |
|---|---|---|---|
| 1,538,415 | 5/1925 | Tootle et al. | 273/172 |
| 2,041,676 | 5/1936 | Gallagher | 273/77 |
| 2,550,846 | 5/1948 | Milligan | 273/77 |
| 3,625,518 | 12/1972 | Solheim | 273/175 |
| 3,655,188 | 4/1972 | Solheim | 273/77 A |
| 3,815,921 | 6/1974 | Turner | 273/174 |
| 3,815,921 | 6/1974 | Swanson | 273/172 |
| 3,941,390 | 3/1976 | Hussey | 273/167 F |
| 4,332,388 | 6/1982 | Crow | 273/167 A |
| 4,553,755 | 11/1985 | Yamada | 273/167 A |
| 4,762,322 | 8/1988 | Molitor et al. | 273/169 |
| 4,795,159 | 1/1989 | Nagamoto | 273/171 |
| 5,076,585 | 12/1991 | Bouquet | 273/167 |
| 5,080,366 | 1/1992 | Okumoto et al. | 273/167 A |
| 5,193,811 | 3/1993 | Okumoto et al. | 273/172 |

FOREIGN PATENT DOCUMENTS 123384 11/1989 Taiwan .

OTHER PUBLICATIONS

Golf Digest, "Pinseeker," May 1976, p. 34.
Golf Digest, "Tracker 7", Aug. 1979, p. 34.

*Primary Examiner*—V. Millin
*Assistant Examiner*—Steven B. Wong
*Attorney, Agent, or Firm*—Darrell F. Marquette; Herbert E. Haynes, Jr.

[57] ABSTRACT

A wood type golf club includes a head attached to one end of a shaft. The head has a total head weight which is used in calculating a swingweight for the golf club. A face portion on a body in the club head is arranged for impacting a golf ball, and a sole plate is attached to a bottom portion of the club head. In order to resist twisting movements of the club head when impacting a golf ball at off-center points located on the body face portion, the sole plate has a majority of its weight concentrated around its perimeter by providing a cavity in an interior surface of the sole plate. The body and the sole plate each have an individual weight which is less than the total head weight. The sole plate is selected from a plurality of sole plates formed of identical material but having different weights. The weight of the selected sole plate is equal to the total head weight minus the weight of the body thereby eliminating the use of additional weighted inserts in the body.

8 Claims, 4 Drawing Sheets

WOOD TYPE GOLF CLUBS

This is a continuation of copending application Ser. No. 07/839,953 filed on Feb. 21, 1992 now abandoned.

BACKGROUND OF THE INVENTION

1. Field of the Invention

This invention relates generally to golf clubs and, in particular, to a type of golf club commonly referred to as "woods" which have an enlarged head attached to one end of an elongated shaft.

2. Description of the Prior Art

A full set of golf clubs generally consists of a correlated set of wood type clubs and a correlated set of iron type clubs. A conventional wood type golf club is disclosed in U.S. Pat. No. 3,625,518 while conventional iron type golf clubs are disclosed in U.S. Pat. No. 3,655,188. Wood type golf clubs have heads constructed of materials such as wood, metal and plastic. Iron type golf clubs have heads usually made of metal.

Referring to FIGS. 1-3, a wood type golf club according to the prior art has an enlarged head 10 including a specially shaped body 12 preferably formed of wood with a hosel 14 which receives and is attached to one end of an elongated shaft 16. A grip (not shown) is mounted on the other end of the shaft 16 so that head 10 may be swung in an arc to contact a golf ball resting on a tee or on the ground. An insert 18 preferably formed of a resin material is centrally mounted in a face portion **12*a* of the body 12, and a metallic sole plate 20 is attached to a bottom portion 12*b* of the body 12 by a plurality of screws 22 and/or epoxy. The sole plate 20 has an arcuate notch 24 at one end and a straight edge 26 at the other end. When the sole plate is attached to the body 12, the notch 24 and the edge 26 are engaged with an arcuate shoulder 28 and a straight shoulder 30, respectively, formed on the body 12. the sole plate 20 also has a curved side 32 and a relatively straight side 34. Shoulder 30 is located in a heel 10*a* of the head 10 while shoulder 28 is located in a toe 10*b* of the head 10**.

When making a wood type golf club that is designated as a driver or a No. 1 wood, a hole 36 shown in FIG. 1 is bored in the bottom of the driver body 12 to remove weight therefrom so that the finished golf club will have a desired swingweight. Swingweight is generally defined as a measurement of a golf club's weight distribution about a point which is at a specified distance from the grip end of the golf club. Hole 36 is necessary because the body 12 in a driver is larger and heavier than in other golf clubs in a correlated set. When making other wood type golf clubs with relatively smaller heads (e.g., those designated as Nos. 3, 5 and 7 woods), holes 38, 40 shown in FIG. 2 are bored in the body 12 and then filled with weighted inserts 39, 41 made of lead or brass in order to provide finished golf clubs of desired swingweights. In a correlated set of wood type golf clubs according to the prior art including for example Nos. 1, 3, 5 and 7 woods, the sole plates 20 on the Nos. 3, 5 and 7 have been made of a heavyweight material such as brass whereas the sole plate 20 on the No. 1 wood has been made of a lightweight material such as aluminum. This helps to reduce, but not eliminate, the additional weight that must be added to the body 12 in the Nos. 3, 5 and 7 woods by using the weighted inserts 39, 41.

The golf club shown in FIGS. 1-3 has the face portion **12*a* of the body 12 arranged for contacting a golf ball. Located on the face portion 12*a* is a center point 11 known as a "sweet spot" which is in general alignment with the center of gravity of the head 10. If the head 10 impacts a golf ball at precisely the sweet spot 11 during a golf swing, maximum energy will be transferred from the head 10 and the golf ball will travel along its intended path. If the club head 10 impacts a golf ball at off-center points 11*a*, 11*b* which are also located on the face portion 12*a* but in the heel and toe 10*a*, 10*b* of the head 10, twisting movements of the head 10 will occur resulting in less than maximum energy being transferred from the head and deviation of the golf ball from its intended path of travel. Such deviation of the golf ball is generally referred to as a "slice" or a "fade" when impacting the head 10 at point 11*a* and as a "hook" or a "draw" when impacting the head 10 at point 11*b***.

SUMMARY OF THE INVENTION

In one aspect of the present invention, a wood type golf club is comprised of a shaft and a head attached to one end of the shaft. The head includes a body with a face portion arranged for contacting a golf ball. A sole plate is attached to a bottom portion of the body. The sole plate has a majority of its weight concentrated around its perimeter preferably by providing a cavity in an interior surface of the sole plate. A first proportion of the sole plate weight is concentrated in a heel of the head, and a second proportion of the sole plate weight is concentrated in a toe of the head. These first and second weight proportions together constitute more than 50 percent of the sole plate weight that is concentrated in the perimeter of the sole plate.

In another aspect of the present invention, a wood type golf club has a desired swingweight in a desired range and includes a head attached to one end of a shaft. The head has a total head weight which is used in calculating the swingweight. The head is comprised of a body with a face portion arranged for impacting a golf ball and a sole plate attached to a bottom portion of the body. The sole plate is selected from a plurality of sole plates formed of identical material but having different weights such that the selected sole plate has a weight which is less than the total head weight of the head. The total head weight is equal to the weight of the body plus the weight of the selected sole plate.

A further aspect of the present invention provides a method of making a wood type golf club having a desired swingweight. The golf club includes a head attached to one end of a shaft. The head has a total head weight which is used in calculating the swingweight. The method comprises the steps of providing a body in the head with a face portion for impacting a golf ball, weighing the body to insure that it has a weight which is within a preselected range that is less than the total head weight, selecting a sole plate from a plurality of sole plates formed of identical material but having different weights such that the selected sole plate has a weight which is equal to the total head weight minus the weight of the body, and attaching the sole plate to a bottom portion of the body.

Another aspect of the present invention provides a correlated set of wood type golf clubs including at least two golf clubs of different number designations wherein one of the number designations is higher than the other number designation. Each golf club includes a head attached to one end of a shaft. The head has a total head weight and a body with a face portion arranged for impacting a golf ball. A sole plate is attached to a bottom portion of the body on each golf club. The sole plate has a weight which is less than the total head weight. An improvement comprises the weight of the sole plate on the golf club with the higher number designation being greater than the weight of the sole plate on the golf club with the other number designation. Both of the sole plates are formed of identical material.

DESCRIPTION OF THE PREFERRED EMBODIMENT

Figure 1:
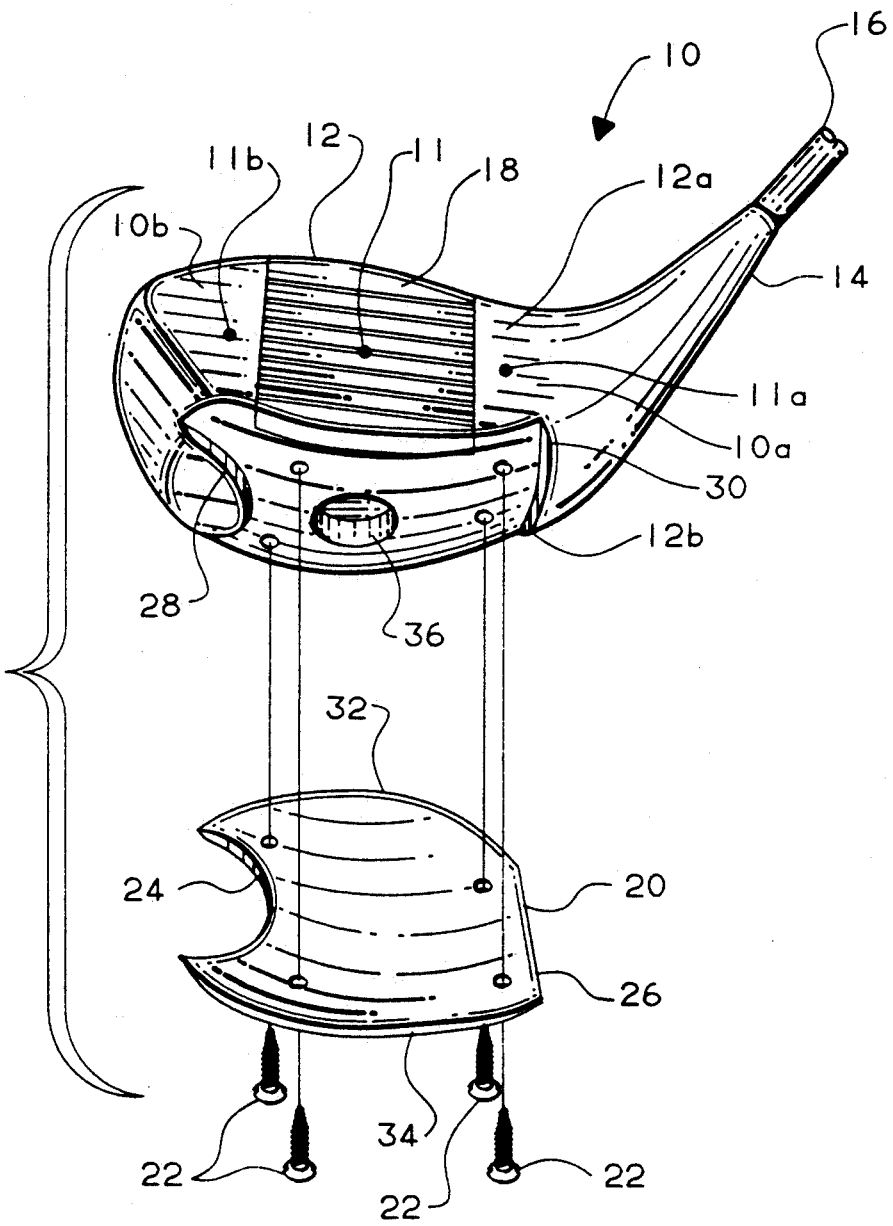
FIG. 1 PRIOR ART
FIG. 1 is an exploded perspective view of a golf club head according to the prior art.
Figure 2:
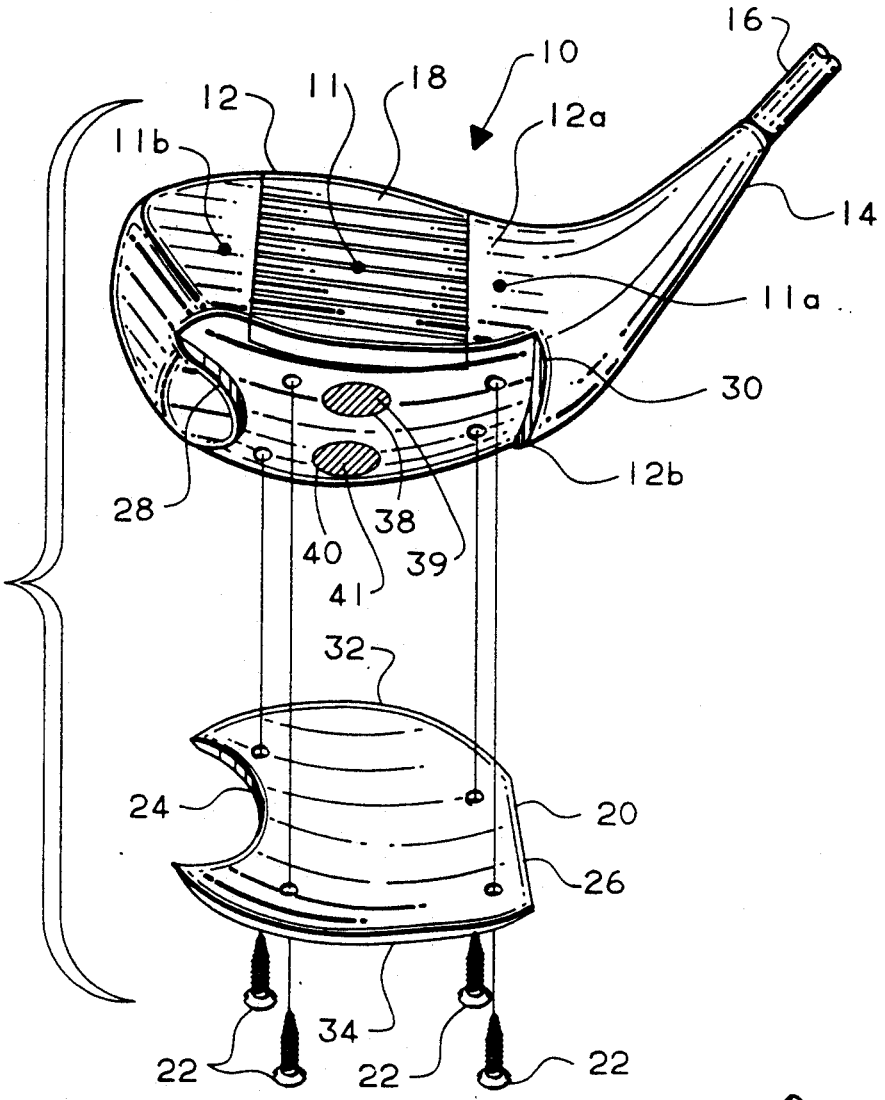
FIG. 2 PRIOR ART
FIG. 2 is an exploded perspective view of another golf club head according to the prior art.
Figure 3:
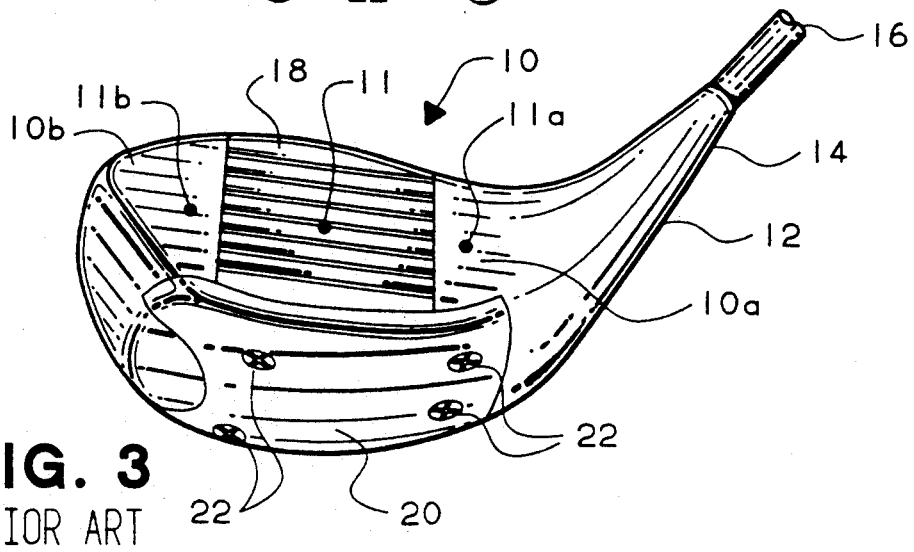
FIG. 3 PRIOR ART
FIG. 3 is a bottom perspective view of the prior art golf club heads shown in FIGS. 1 and 2 taken when they are assembled.
Figure 4:
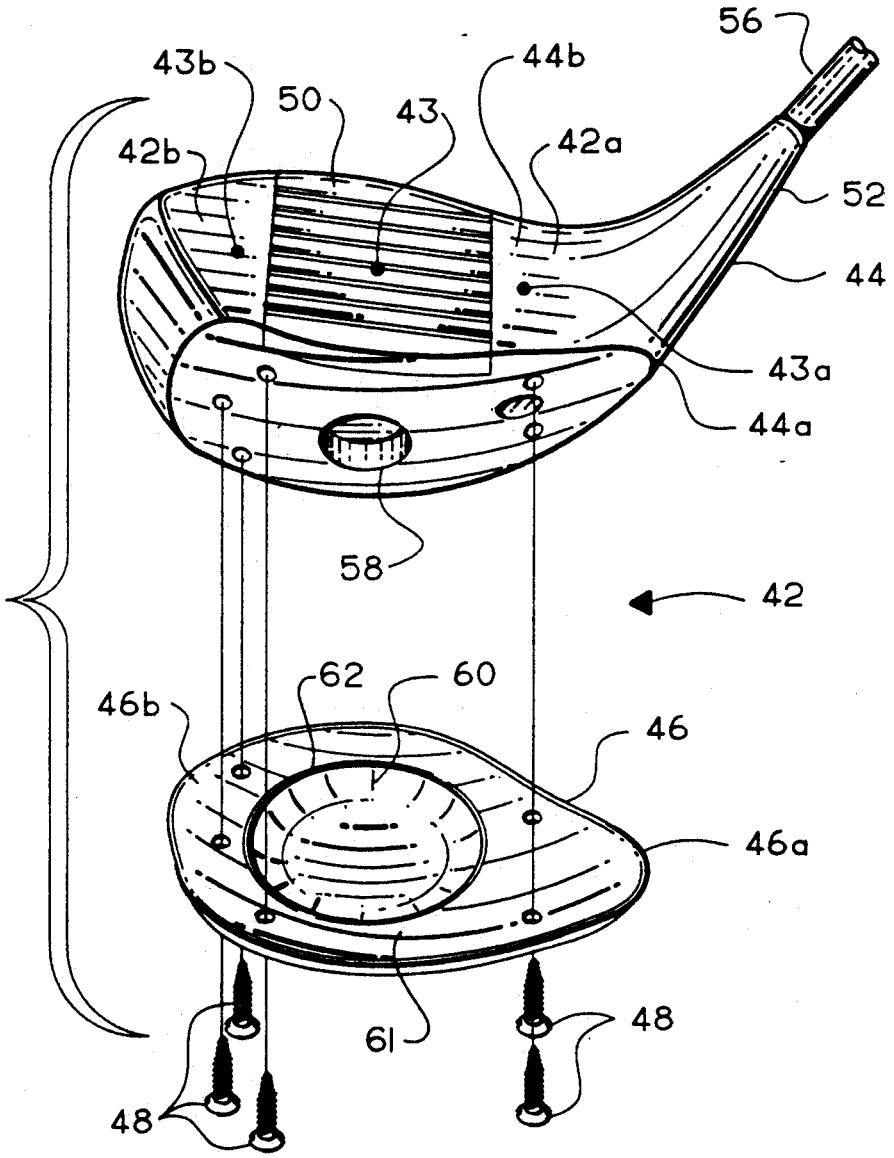
FIG. 4 is an exploded perspective view of a golf club head according to the preferred embodiment of the present invention.
Figure 5:
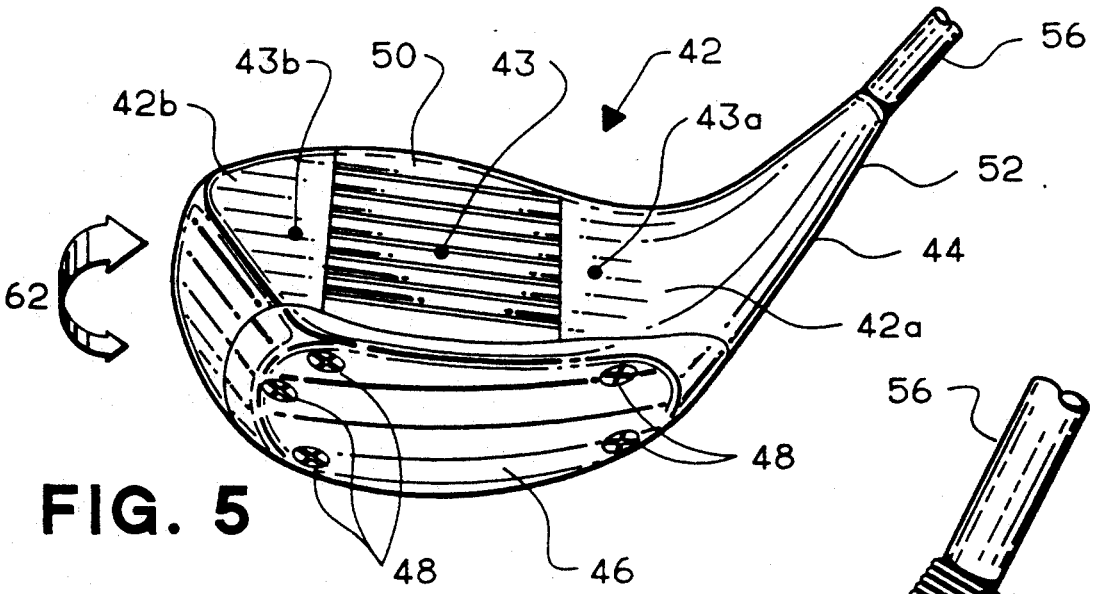
FIG. 5 is a bottom perspective view of the golf club head shown in FIG. 4 taken when it is fully assembled.

Referring to FIG. 4, a wood type golf club according to the preferred embodiment of the present invention includes an enlarged head 42 having a specially shaped body 44 and a sole plate 46 which is attached to a bottom portion 44*a* of the body 44 by conventional means such as a plurality of screws 48 and/or epoxy. The body bottom portion 44*a* has a bottom surface of compound curvature. An insert 50 preferably formed of a resin material is mounted in a face portion 44*b* of the body 44. The face portion 44*b* is arranged for impacting a golf ball. The body 44 includes a neck or hosel 52 with a bore 54 (FIG. 6) therethrough for receiving and attachment to one end of an elongated shaft 56. Mounted on the other end of the shaft 56 is a grip (not shown). In the preferred embodiment of the head 42, body 44 is formed of wood and sole plate 46 is made of metal. Alternatively, body 44 could be made of other suitable materials such as plastic or metal.

If the head 42 is manufactured for use on a wood type golf club designated as a driver (i.e. No. 1 wood) with the body 44 made of wood, a hole 58 is bored in the bottom of the body 44 to remove weight therefrom so that when the sole plate 46 is attached, the head 42 will have a desired total head weight which is used in calculating a swingweight for the golf club. As previously stated swingweight is generally defined as a measurement of a golf club's weight distribution about a point which is at a specified distance from the grip end of the golf club. If the head 42 is manufactured for use on a wood type golf club such as those designated as a No. 3, 5 or 7 wood with the body 44 made of wood, no weight is removed from the body 44 before attachment of the sole plate 46. Therefore, in all woods except the driver such as the Nos. 3, 5 and 7 woods, the boring of hole 58 is not required.

The swingweight for the golf club shown in FIGS. 4–7 is determined by taking into account the total head weight of the head 42 and other factors such as the weight and length of the shaft 56. The body 44 and the sole plate 46 each have an individual weight which is less than the total head weight of the head 42. When making the head 42, the body 44 is weighed to insure that its weight is within a preselected range, and then the sole plate 46 is selected from a plurality of sole plates which are formed of identical material (e.g., aluminum) but have different weights so that the weight of the selected sole plate 46 is equal to the total head weight less the weight of the body 44. Instead of using additional weights (e.g., weighted inserts 39, 41) in the body 44 to compensate for deficiencies in the total head weight of the head 42 as in prior art golf clubs, the weight of the sole plate 46 is increased by merely selecting a heavier sole plate.

Figure 6:
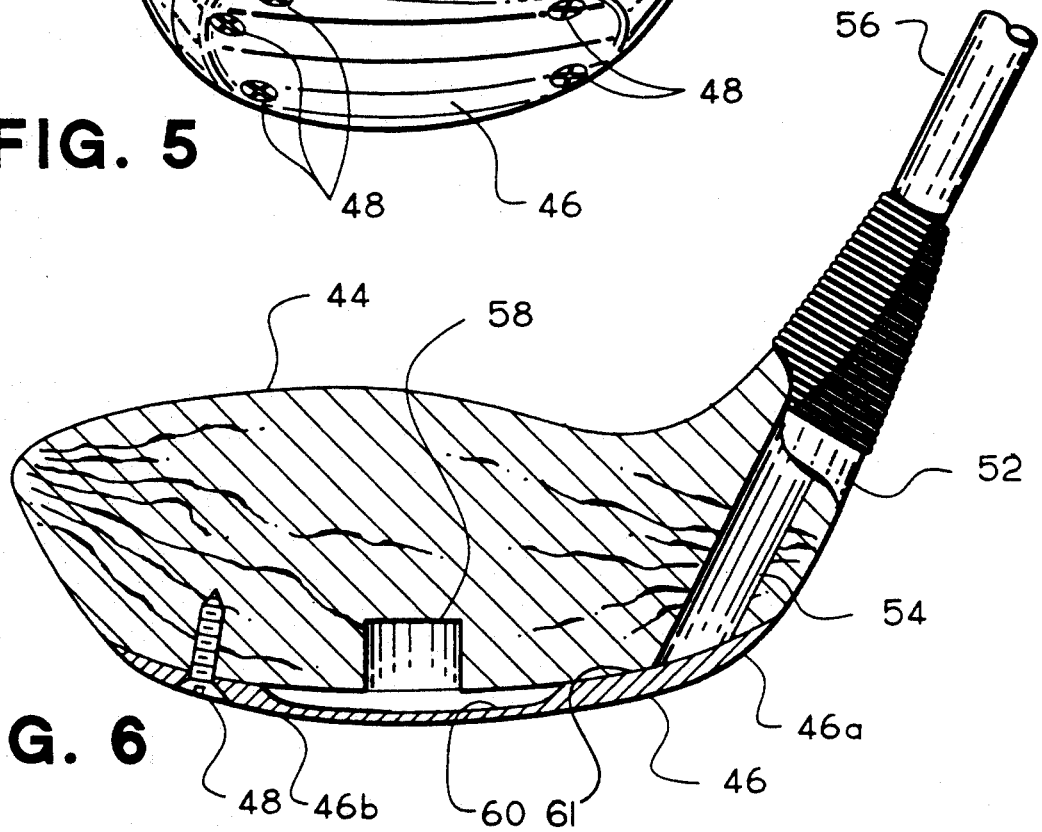
FIG. 6 is a vertical cross-sectional view of the golf club head shown in FIG. 5.
Figure 7:
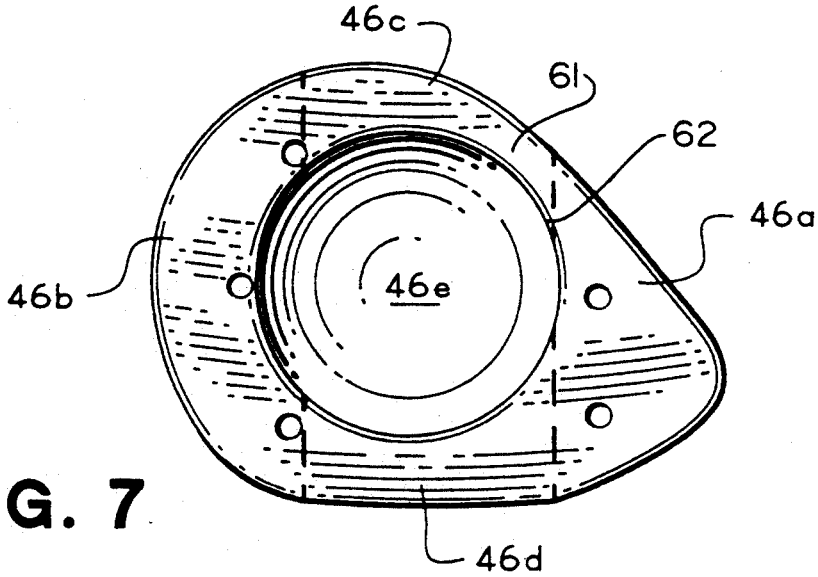
FIG. 7 is a top plan view of a sole plate used in the golf club head of FIGS. 4–6.

As seen in FIGS. 4, 6, and 7, the sole plate 46 has a substantially circular cavity 60 formed in its interior surface and located generally intermediate a heel 42*a* and a toe 42*b* of the club head 42. The cavity 60 has inclined side walls and a relatively flat bottom wall. The inclined side walls of the cavity 60 form an acute angle with the bottom surface of the body 44 which is adjacent the hole 58 as best shown in FIG. 6. Alternatively, the cavity 60 could be of a different shape such as an oval. The purpose of cavity 60 is to concentrate a majority of the weight of the sole plate 46 in perimeter sections 46*a*, 46*b*, 46*c* and 46*d* (FIG. 7) of the sole plate 46 by reducing the weight of the sole plate 46 in its center section 46*e*. The sole plate 46 also has a ledge 61 disposed in perimeter sections 46*a*, 46*b*, 46*c*, 46*d* and extending peripherally of the cavity 60 for contacting the bottom portion 44*a* of the body 44. Thus, the cavity 60 in the sole plate 46 results in perimeter weighting of the club head 42. An advantage of this perimeter weighting is improved weight distribution in the heel and toe 42*a*, 42*b* of the club head 42 which causes the club head 42 to resist twisting movements in directions indicated by arrow 62 in FIG. 5 when impacting a golf ball at off-center points 43*a*, 43*b* located on the body face portion 44*b* in the heel and toe 42*a*, 42*b* of the head 42. No such twisting movements of the club head 42 occur when impacting a golf ball at a center point or "sweet spot" 43 which is also located on the body face portion 44*b*.

The sole plate 46 has an extended heel section 46*a* and an extended toe section 46*b*. The extended heel section 46*a* concentrates a first proportion of the perimeter weight of the sole plate 46 in the heel 42*a* of the club head 42 while the extended toe section 46*b* concentrates a second proportion of the sole plate perimeter weight in the club head toe 42*b*. When combined, these first and second perimeter weight proportions constitute more than 50 percent of the perimeter weight of the sole plate 46.

The cavity 60 has an outer edge 62 extending in a generally circular path. The outer edge 62 also defines an inner extremity of the ledge 61 which extends through all of the perimeter sections 46*a*, 46*b*, 46*c* and 46*d* of the sole plate 46. The ledge 61 extends outwardly in all directions from the outer edge 62 of the cavity 60 and has an upper surface which is elevated above a bottom surface of the cavity 60. The sole plate heel perimeter section 46*a* is located adjacent the heel 42*a* of the head 42, the sole plate toe perimeter section 46*b* is located adjacent the toe 42*b* of the head, and the forward and rearward central perimeter sections, 46*c* and 46*d* are located forwardly and rearwardly, respectively, of the cavity 60 between the heel and toe perimeter sections 46*a*, 46*b*. As shown in FIG. 7, the heel perimeter section 46*a* has a generally triangular shape in plan view, and the toe perimeter section 46b, and central perimeter sections 46c, 46d are generally C-shaped in plan view.

It should be noted that the sole plate 46 does not have a notch such as notch 24 in sole plate 20 or a straight edge such as straight edge 26 on sole plate 20. Therefore, the sole plate 46 is significantly heavier at its ends than the sole plate 20 thereby resulting in the club head 42 having increased heel and toe weighting when compared with the club head 10. Due to the cavity 60, sole plate 46 has significantly less weight at its center than the sole plate 20. This also contributes to the improved heel and toe weighting of the club head 42.

It will be understood that when the club head 42 is constructed for use on a golf club designated as a No. 1 wood, the sole plate 46 will weigh less than when the club head 42 is constructed for use on a golf club designated as a No. 3, 5 or 7 wood. This is because in a No. 1 wood, the body 44 weighs more than in the other woods. In all of the woods, the combined weights of the body 44 and the sole plate 46 must be within a preselected range in order to provide a desired swingweight.

In a correlated set of golf clubs, the diameter and the depth of the cavity 60 may be changed in order to increase or decrease the weight of the sole plate 46. For example in a No. 5 wood, the cavity 60 has a smaller diameter and is shallower than in a No. 3 wood which results in the sole plate weight being greater in the No. 5 wood.

What is claimed is:

1. A wood type golf club comprising:

a shaft;

a head attached to one end of said shaft, said head including a heel, a toe, and a body having a face portion arranged for impacting a golf ball;

a sole plate attached to a bottom portion of said body, said sole plate having a weight and a substantially circular cavity formed in a center section thereof which decreases the sole plate weight in said center section while increasing the sole plate weight in perimeter sections thereof, said cavity having an outer edge extending in a generally circular path, said sole plate also having a ledge circumscribing said cavity and contacting said bottom portion of said body, said outer edge of said cavity defining an inner extremity of said ledge with said ledge extending outwardly in all directions from said outer edge of said cavity and having an upper surface which is elevated above a bottom surface of said cavity; and said perimeter sections of said sole plate including a heel perimeter section located adjacent said heel of said head, a toe perimeter section located adjacent said toe of said head, a forward central perimeter section located forwardly of said cavity between said heel and toe sections, and a rearward perimeter central section located rearwardly of said cavity between said heel and toe sections, said ledge extending through all of said sole plate perimeter sections.

2. The wood type golf club of claim 1, wherein:

said heel section of said sole plate concentrates a first proportion of the sole plate weight in said heel of said head;

said toe section of said sole plate concentrates a second proportion of the sole plate weight in said toe of said head; and said first and second proportions together constitute more than 50 percent of said majority of the sole plate weight.

3. The wood type golf club of claim 1, wherein:

said sole plate has an interior surface and an exterior surface; and said cavity is formed in the interior surface of said sole plate.

4. The wood type golf club of claim 3, wherein said cavity has inclined side walls which form an acute angle with a bottom surface of said body.

5. The wood type golf club of claim 1, wherein said cavity is located generally intermediate said heel and said toe of said head.

6. The wood type golf club of claim 5, wherein said body is formed of wood, and wherein said sole plate is made of metal.

7. The wood type golf club of claim 1, wherein said cavity is formed in an interior surface of said sole plate and wherein said bottom surface thereof is spaced from a bottom surface of said body when said sole plate is attached to said bottom portion of said body.

8. The wood type golf club of claim 1, wherein said sole plate heel perimeter section has a generally triangular shape in plan view, and wherein said sole plate toe perimeter section and said sole plate forward and rearward central perimeter sections are each generally C-shaped in plan view.

* * * * *